United States Patent [19]

Wakeman

[11] 4,284,055

[45] Aug. 18, 1981

[54] RECIPROCATING PISTON INTERNAL COMBUSTION ENGINE

[75] Inventor: Anthony C. Wakeman, Birmingham, England

[73] Assignee: Lucas Industries, Limited, Birmingham, Great Britain

[21] Appl. No.: 82,545

[22] Filed: Oct. 9, 1979

[30] Foreign Application Priority Data

Oct. 14, 1978 [GB] United Kingdom ..... 40591/78

[51] Int. Cl.[3] ..... F02B 3/00

[52] U.S. Cl. ..... 123/556; 123/292; 123/291; 123/294; 123/254

[58] Field of Search ..... 123/292, 291, 294, 556, 123/254, 286, 179 H, 554

[56] References Cited

U.S. PATENT DOCUMENTS

| | | | |
|---|---|---|---|
| 1,258,155 | 3/1918 | Shepherd | 123/254 |
| 2,590,000 | 3/1952 | Ferguson | 123/291 |
| 3,580,231 | 5/1971 | Bradbury | 123/292 |
| 3,677,026 | 7/1972 | Granryd | 123/556 |
| 3,677,027. | 7/1972 | Granryd | 123/556 |
| 3,809,030 | 5/1974 | Moiroux | 123/254 |
| 3,911,878 | 10/1975 | Hofbauer | 123/292 |
| 3,929,107 | 12/1975 | Renger | 123/292 |
| 4,223,645 | 9/1980 | Nohira | 123/292 |

FOREIGN PATENT DOCUMENTS

| | | | |
|---|---|---|---|
| 131013 | 8/1919 | United Kingdom | 123/292 |
| 178480 | 4/1922 | United Kingdom | 123/556 |
| 237119 | 7/1925 | United Kingdom | 123/556 |
| 241285 | 10/1925 | United Kingdom | 123/556 |
| 241490 | 10/1925 | United Kingdom | 123/556 |
| 386061 | 1/1933 | United Kingdom | 123/556 |
| 528391 | 10/1940 | United Kingdom | 123/556 |
| 640410 | 7/1950 | United Kingdom | 123/292 |
| 761122 | 11/1956 | United Kingdom | 123/556 |
| 1308355 | 2/1973 | United Kingdom | 123/556 |
| 1440595 | 6/1976 | United Kingdom | 123/596 |

*Primary Examiner*—Ronald B. Cox

*Attorney, Agent, or Firm*—Schwartz, Jeffery, Schwaab, Mack, Blumenthal & Koch

[57] ABSTRACT

A low compression ratio internal combustion engine including a piston and cylinder arrangement the working volume of which is bounded in part by the piston crown and the cylinder head and in part by inlet valve means whereby an inlet charge can enter the working volume and exhaust valve means whereby products of combustion occuring within the working volume can leave the working volume. A regenerative heat exchanger is located within said working volume, the heat exchanger having a hot face and a cold face between which gases are caused to flow. The inlet charge is caused to flow through the heat exchanger from the cold face to the hot face so as to be heated thereby immediately prior to the combustion stage of the engine operating cycle, the burning and expanding fuel/air mixture are caused to act directly on the piston of the piston and cylinder arrangement without passing through the heat exchanger, and the products of combustion are subsequently caused to flow through the heat exchanger from the hot face to the cold face to heat the heat exchanger before leaving the working volume by way of the exhaust valve means.

14 Claims, 19 Drawing Figures

FIG.7
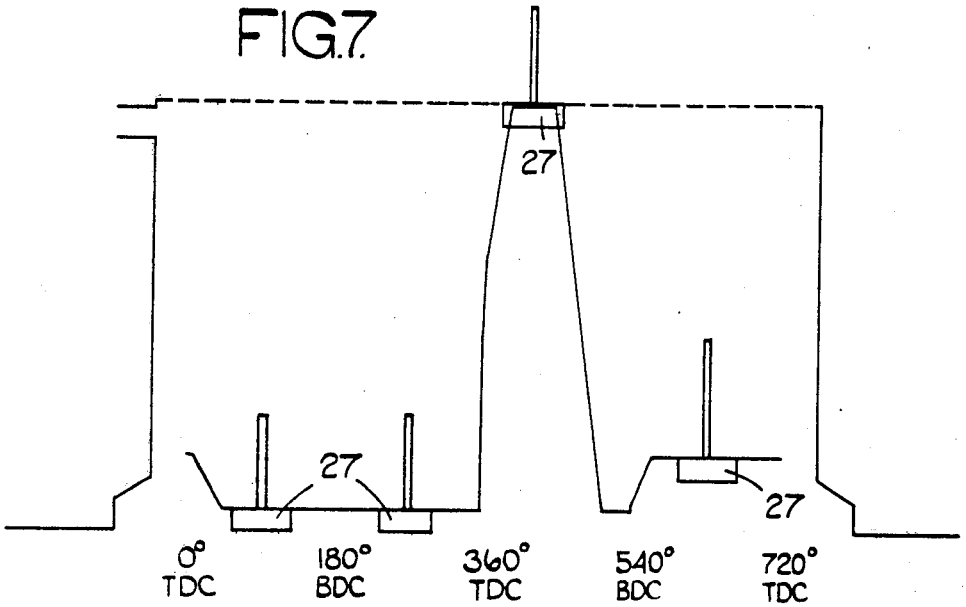
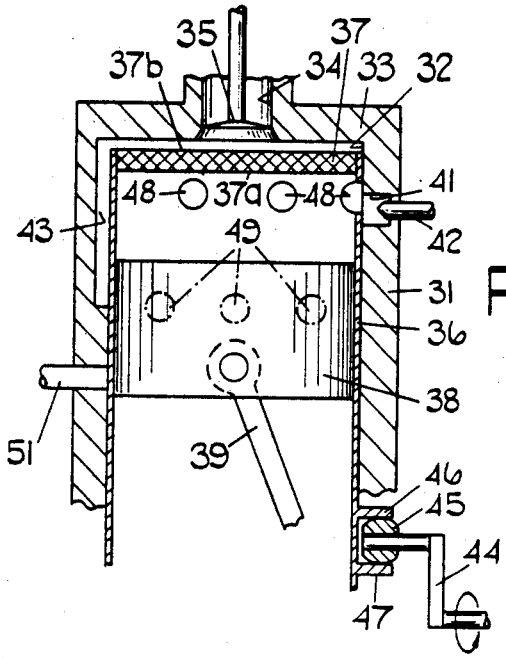
FIG.8.

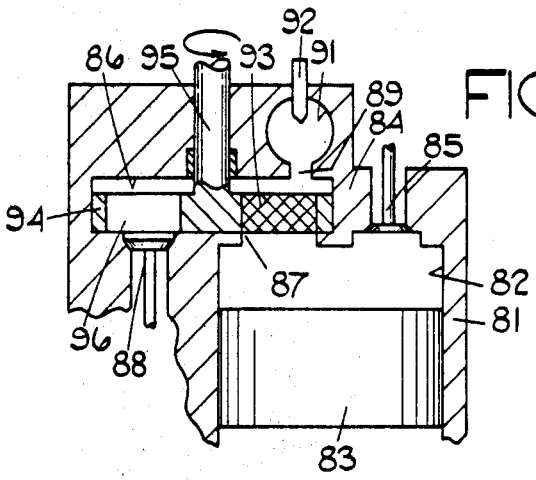
FIG. 13.
FIG. 14.
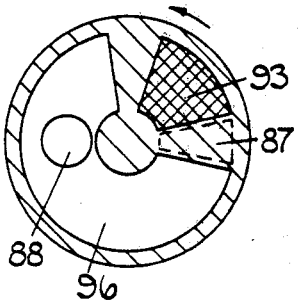
FIG. 15.
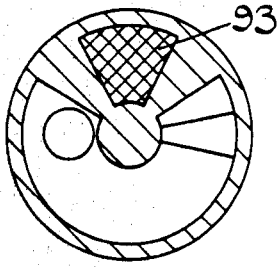
FIG. 16.
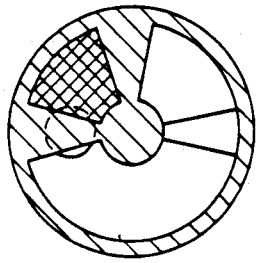
FIG. 17.
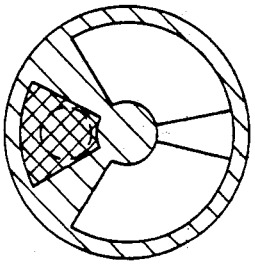
FIG. 18.
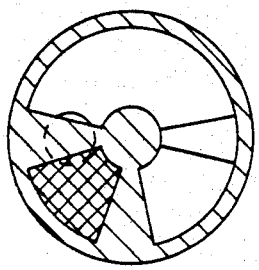
FIG. 19.
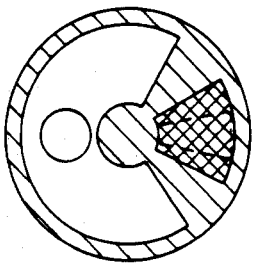

RECIPROCATING PISTON INTERNAL COMBUSTION ENGINE

BACKGROUND OF THE INVENTION

This invention relates to a reciprocating piston internal combustion engine.

The best known form of reciprocating internal combustion engine is the spark ignition petrol engine as used in many automobiles. It has the advantage of being relatively cheap to manufacture but suffers from low thermal efficiency due inter alia to the direct discharge of its hot exhaust gases to atmosphere. Attempts have been made to improve the thermal efficiency of internal combustion engines, for example the compression ignition diesel engine as used on many commercial vehicles, which uses higher compression ratios than those used on petrol engines, and thereby obtains a lower temperature exhaust. A further engine operating on an even higher compression ratio and thereby lowering the exhaust temperature still further, is the Wishart engine. However, these higher compression ratio engines unfortunately suffer from high friction losses, increased heat losses and pumping (pressure) losses.

An approach alternative to using higher compression ratio engines while at the same time improving on the thermal efficiency of the petrol engine, is to reclaim heat from the exhaust to increase the temperature of the charge admitted to the engine. For example, the automotive gas turbine uses a rotating regenerative heat exchanger having a cold face at one axial end and a hot face at its other end. Air is compressed in a compressor and is transferred from the cold to the hot side of part of the rotating heat exchanger, where fuel is continuously injected to cause spontaneous combustion and drive the power turbine/compressor.

Hot exhaust gases are passed from the hot to the cold side of the other part of the rotating heat exchanger which absorbs heat from the exhaust and then imparts this heat to the incoming compressed air. However, such engines particularly when of small size and operating under part load conditions tend to be inefficient and of course are expensive to manufacture. Another example of an attempt to recover exhaust heat is as an ancillary feature of the Wishart engine mentioned previously. In this form the Wishart engine uses a static recuperative heat exchanger having a cold face at one axial end presented to an external compressor and a hot face at the other end presented to a power reciprocating piston and cylinder which contains a spark plug. Highly compressed air from the compressor passes from the cold side to the hot side of the heat exchanger, where a very high octane number fuel (e.g. methane) is intermittently injected into the heated compressed air, and the hot charge passes into the power cylinder via a transfer valve where it is ignited by the spark plug. Heat is transferred from the exhaust gases passing from the hot to the cold side of the heat exchanger. Thus this form of the Wishart engine retains the disadvantages of the losses associated with high compression ratio engines and, for high thermal efficiency requires an expensive separate compressor means.

SUMMARY OF THE INVENTION

It is an object of the present invention to provide a low compression ratio reciprocating piston internal combustion engine which has the advantage of the relatively low manufacturing cost of the known petrol and diesel engines coupled with a superior thermal efficiency.

The term "recuperative heat exchanger" is used herein to mean a heat exchanger wherein the fluid to be heated flows through a passage or passages totally separate from the passage or passages through which the heating fluid flows, the heat of the heating fluid being transferred to the fluid to be heated by way of the wall or walls separating the passages.

The term "regenerative heat exchanger" is used herein to mean a heat exchanger wherein the fluid to be heated flows through the same passage or passages as the fluid which heats the exchanger, the two fluids flowing through the exchanger at different times. Thus in a regenerative heat exchanger heat is absorbed from the heating fluid by the walls of the passage or passages, which walls then subsequently give up their heat to the fluid to be heated.

The term "charge" is used herein as the context dictates, to mean, in the case of a carburetted engine, the fuel/air mixture, and in the case of a fuel injected engine, the air portion of the fuel/air mixture.

A low compression ratio reciprocating piston internal combustion engine according to the present invention comprises a piston and cylinder arrangement including a working volume in which the compression and power stages of the engine operating cycle occur, the working volume being bounded in part by the piston crown and the cylinder head and in part by inlet valve means whereby an inlet charge can enter the working volume and exhaust valve means whereby products of combustion occuring within the working volume can leave the working volume, a regenerative heat exchanger located within said working volume, the heat exchanger having a hot face and a cold face between which gases are caused to flow, and, means whereby the charge is caused to flow through the heat exchanger from the cold face to the hot face so as to be heated thereby immediately prior to the combustion stage of the engine operating cycle, the burning and expanding fuel/air mixture is caused to act directly on the piston of the piston and cylinder arrangement without passing through the heat exchanger, and the products of combustion are subsequently caused to flow through the heat exchanger from the hot face to the cold face to heat the heat exchanger before leaving the working volume by way of the exhaust valve means.

Conveniently the hot face of the regenerative heat exchanger is permanently exposed to the crown of the piston and said means includes a by-pass whereby during compression of the inlet charge, the charge can flow through said by-pass to the region of the cold face of the heat exchanger without passing through the heat exchanger.

Alternatively said heat exchanger is movable within the working volume between a first position wherein the cold face thereof is exposed to the piston crown and a second position wherein the hot face is exposed to the piston crown, the exchanger occupying its first position during compression of the charge and dividing the working volume so that the charge is caused to be heated by passing through the heat exchanger from the cold face to the hot face prior to combustion and the heat exchanger occupying its second position during the power and exhaust stages wherein the burning and expanding fuel/air mixture can act directly on the piston, and the resultant products of combustion are caused to flow through the heat exchanger from the hot face to the cold face, heating the heat exchanger, to leave the working volume by way of the exhaust valve means.

Conveniently where said means includes said by-pass said heat exchanger is static within said working volume, and said means further includes a displacer piston movable within said working volume to drive the compressed charge through the heat exchanger from the cold face to the hot face, said by-pass permitting the compressed charge to flow into a region of the working volume between the displacer piston and the cold face of the heat exchanger.

Alternatively where said means includes said by-pass said heat exchanger is movable relative to the cylinder of the piston and cylinder arrangement and relative movement between the piston and the heat exchanger drives the charge through the by-pass from the hot face of the heat exchanger to the cold face without passing through the heat exchanger.

Conveniently the piston and cylinder arrangement includes a first piston and cylinder and a second piston and a cylinder and passage means provides communication between the first and second cylinders, the swept volume of the first and second cylinders and the volume of said passage means contributing to the total working volume of the arrangement said pistons being coupled to a common crankshaft but being out of phase by a predetermined arc of crankshaft rotation with the first piston leading the second piston, and during compression of an inlet charge initially said charge is exposed to the hot face of the heat exchanger but is compressed by both pistons into the second cylinder which during the conclusion of the compression stroke is exposed to the cold face of the heat exchanger so that the compressed charge can flow through the heat exchanger from the cold face to the hot face immediately before combustion takes place.

Desirably said heat exchanger is located in a passage of said passage means with its hot face permanently exposed to the first piston and its cold face exposed, when a transfer valve is open, to the second piston, said exhaust valve means being exposed to the heat exchanger cold face and said inlet valve means comprising first and second inlet valves providing inlets to the first and second cylinders respectively and said passage means including conduit means which, together with that part of said passage from the second cylinder to the heat exchanger cold face, defines a by-pass whereby during the conclusion of the compression stage of the engine operating cycle compressed charge from the first cylinder can reach the cold face of the heat exchanger without flowing through the heat exchanger from the hot face thereof.

Preferably irrespective of how the charge is caused to flow through the exchanger from cold face to hot face, the products of combustion are caused to flow through the exchanger from hot face to cold face by the movement of the working piston towards top dead centre.

Desirably the inlet charge is air and fuel is supplied into the working volume via a fuel injector.

Preferably fuel injection occurs to proximate the hot face of the heat exchanger.

Conveniently the working volume includes a swirl chamber which receives heated charge from the exchanger and the fuel injector is arranged to supply fuel to the swirl chamber.

BRIEF DESCRIPTION OF THE DRAWINGS

In the accompanying drawings:

FIG. 7 is a graphic representation of the operating cycle of the engine shown in FIG. 1;

FIG. 8 is a view similar to FIG. 1 of an engine in accordance with a second example of the present invention;

FIG. 13 is a view similar to FIG. 1 of an engine in accordance with a third example of the present invention; and FIGS. 14 to 19 inclusive are views illustrating the operation cycle of the engine shown in FIG. 13.

DETAILED DESCRIPTION OF THE PREFERRED EMBODIMENTS

Figure 1:
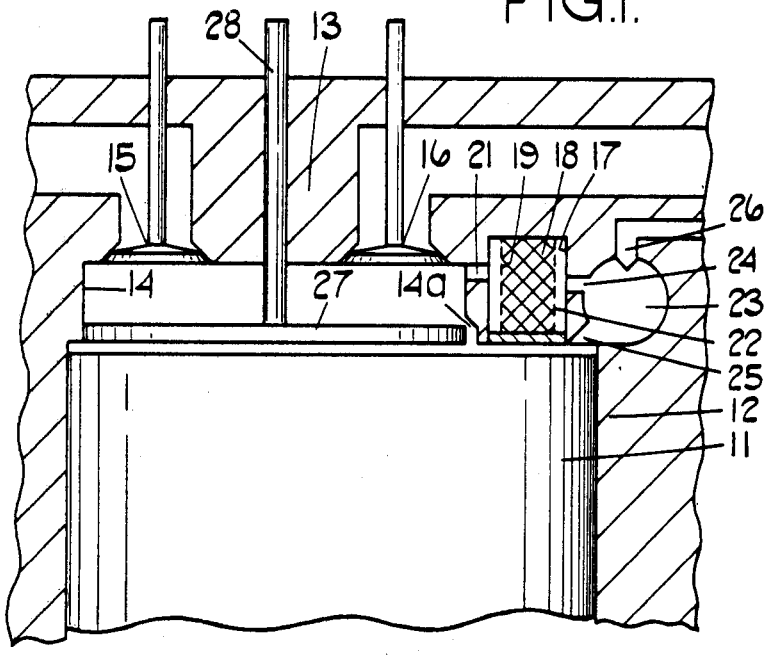
FIG. 1 is a diagrammatic sectional view of a reciprocating piston internal combustion engine in accordance with a first example of the present invention.

Referring first to FIG. 1 of the accompanying drawings the engine comprises a piston and cylinder arrangement wherein a piston 11 is reciprocable mounted within a cylinder 12. The cylinder head 13 of the engine is formed with a cylindrical recess 14 the open end of which is flared over part of its circumference at **14*a*. The working volume of the cylinder 12 includes the recess 14, and air can enter the working volume by way of an inlet valve 15, and combustion products can leave the working volume by way of an exhaust valve 16 positioned at the end of the recess 14 remote from the piston 11. A chamber 17 in the cylinder head 13 alongside the recess 14 contains a fixed regenerative heat exchanger 18**.

The heat exchanger 18 can take a number of forms, and its primary function is to absorb heat from hot gas flowing therethrough, and to impart the absorbed heat to cooler gases subsequently flowing therethrough. The heat exchanger should not impede the gas flow, and can take a number of forms consistent with the above requirements. Thus, the regenerative heat exchanger may be formed from metal mesh or coiled metal wire, the choice of metal being determined by the nature and temperature of the gases to which the heat exchanger will be exposed. Such heat exchangers have previously been proposed, as have regenerative heat exchangers formed from a honeycomb of ceramic material. In some respects ceramic heat exchangers may be preferred owing to their greater tolerance to high temperatures and corrosive atmospheres. A wide variety of heat exchanger forms can be made in the materials mentioned above.

One face 19 of the fixed regenerative heat exchanger 18 communicates with the end of the recess 14 adjacent the exhaust valve 16 by way of a port 21, the opposite face 22 of the heat exchanger 18 communicating with a swirl chamber 23 by way of a port 24. The swirl chamber 23 communicates by way of a port 25 with the upper end of the cylinder 12, and a fuel injector 26 is arranged, in use, to discharge into the swirl chamber 23.

A displacer piston 27 carried by a push rod 28 is slidable within the chamber 14, the push rod 28 being received in a guide in the cylinder head 13. The flared portion 14*a* of the periphery of the recess 14 establishes communication between the upper end of the cylinder 12 and the recess 14 when the piston 27 is at the lower end of its stroke within the recess 14. It will be recognised, that when the piston 27 is raised beyond the flared region 14*a* of the periphery of the recess 14 then the only communication which can exist between the recess 14 above the piston 27 and the cylinder 12 below the piston 27 is by way of the heat exchanger 18 and swirl chamber 23.

The engine illustrated in FIG. 1 is a four-stroke engine and the operating cycle thereof is as follows.

Figure 2:
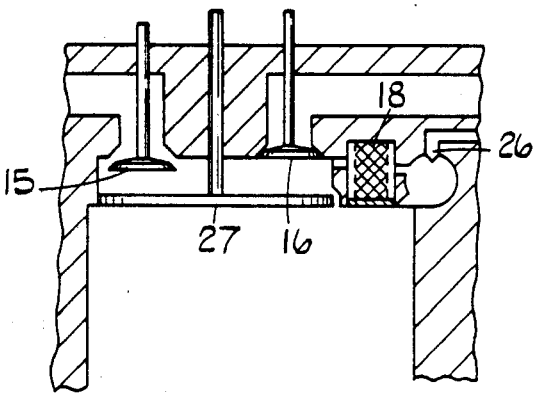
FIGS. 2 to 6 inclusive are views illustrating the operating cycle of the engine shown in FIG. 1.
Figure 3:
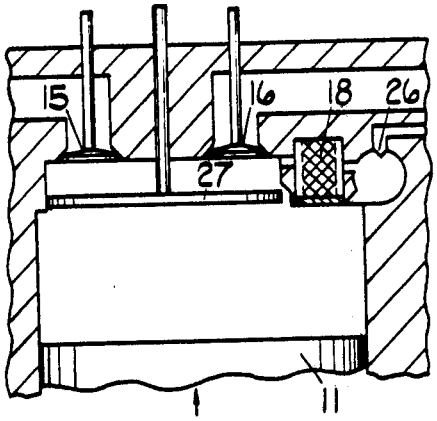
Figure 4:
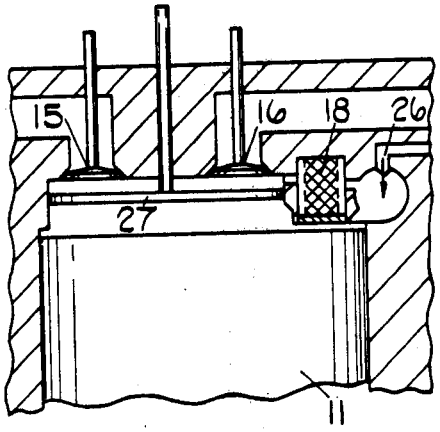
Figure 5:
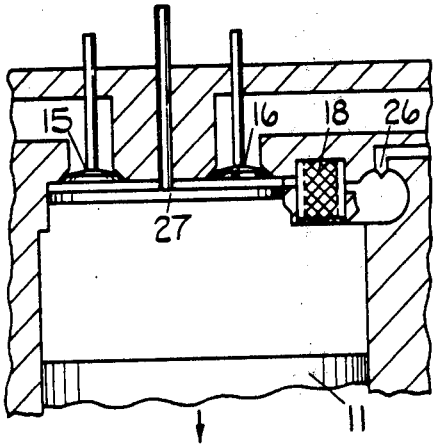
Figure 6:
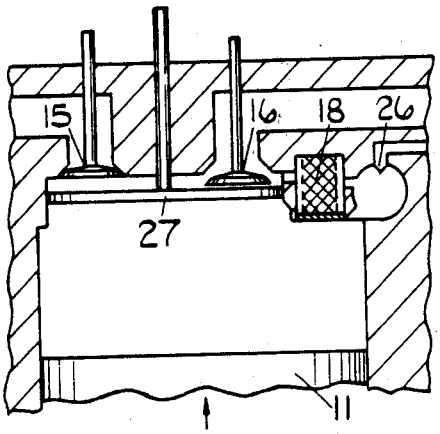

At the commencement of the induction stroke (FIG. 2) the inlet valve 15 is opened and the piston 27 is at the lowermost point in its stroke so that the by-pass passage defined in part by the flared region 14*a* is open. A charge of air is thus drawn into the cylinder 12 by the downward movement of the piston 11, and as the piston 11 passes its bottom dead centre position the inlet valve 15 closes and in the subsequent compression stroke (FIG. 3) the air from the cylinder 12 is compressed into the recess 14 by way of the flared region 14*a*. As the piston 11 approaches its top dead centre position the piston 27 starts to move upwardly closing the by-pass passage defined by the flared region 14*a*. The piston 27 thus drives the air compressed within the recess 14 through the port 21, through the heat exchanger 18, and the port 24 into the swirl chamber 23. As the piston 11 starts to move again downwardly in its power stroke (FIG. 4) fuel is injected by way of the injector 26 into the now heated air entering the swirl chamber 23. Spontaneous combustion occurs as a result of the high temperature of the air issuing from the heat exchanger 18 into the swirl chamber 23 and the expanding gases arising from combustion pass through the port 25 and into the cylinder 12 thus driving the piston 11 downwardly in its power stroke (FIG. 5). At the end of the power stroke the piston 11 starts to rise again, (FIG. 6), the piston 27 assumes an intermediate position whereby the by-pass passage is closed, and the exhaust valve 16 is opened. Thus the products of combustion cannot reach the exhaust valve 16 by way of the recess 14 since this path is blocked by the piston 27. The combustion products are thus driven through the port 25, the swirl chamber 23, the port 24, the heat exchanger 18, and the port 21 to reach the open exhaust valve. The hot exhaust gases flowing through the heat exchanger 18 thus heat the heat exchanger in readiness for a further cycle of operation. It will be recognized that upon initial starting of the engine the heat exchanger will be cold, and thus the compressed air within the recess 14 above the piston 27 which is forced through the heat exchanger to reach the swirl chamber will not be heated during the first cycle of operation. In order to promote starting of the engine it may therefore be desirable to incorporate a sparking plug, or other ignition devices, in the swirl chamber 23. However, as soon as the heat exchanger 18 has been heated by the flow of exhaust gases therethrough the use of an ignition device in the swirl chamber is considered to be unnecessary, since the air passing through the heated heat exchanger 18 to reach the swirl chamber 23 will achieve a sufficient temperature to ensure spontaneous combustion upon injection of fuel in to the chamber 23.

The foregoing description of the operation describes the basic movements of the various parts which must occur. However, certain modifications are possible to improve efficiency. For example, as the piston 27 is moving upwardly to sweep compressed air through the heat exchanger 18 the piston 27 may be moved upwardly more rapidly during the initial part of its upward movement than during the remainder of its upward movement so as to ensure a steady flow of air through the heat exchanger by compensating for the pressure increase, which occurs during combustion in the swirl chamber and in the cylinder 12 below the piston 27. It will be recognized that the piston 27 shields the cold face 19 of the heat exchanger from the combustion products in the cylinder 12 during the power stroke. Desirably the piston 27 remains in its uppermost position for a short period during the first half of the power stroke, and at approximately half way through the power stroke, when the temperature of the combustion products will have fallen substantially by comparison with the very high temperature which occurs at the commencement of combustion, the piston 27 is moved downwardly to its lowest point. This motion causes a small proportion of the total combustion product to flow through the heat exchanger 18 thus purging any retained air from the heat exchanger. Mixing of the purged gases with the bulk of the combustion products occurs as the displacer piston 27 reaches its lowermost position. At this stage the piston 11 reaches its bottom dead centre position and commences to ascend to perform the exhaust stroke. Immediately at the commencement of the exhaust stroke the piston 27 is moved from its lowermost position to the intermediate position such that the by-pass passage by way of the flared region 14*a* is closed thus ensuring that the hot exhaust gases must flow through the heat exchanger 18 to reach the exhaust valve. However, the return of the piston 27 to the intermediate position closing the by-pass passage can, if desired, be delayed to permit some of the combustion products to pass through the recess 14 to the exhaust valve without flowing through the heat exchanger 18, thereby controlling the temperature increase in the heat exchanger 18 during the exhaust stroke. Such an arrangement may be required where the chosen combination of fuel/air mixture and compression ratio could otherwise result in over-heating of the heat exchanger.

It will be recognized that in order to control the power output of the engine a throttle valve will be employed in the air supply to the engine and the quantity of fuel delivered to the injector 26 will be controlled in accordance with the mass air flow into the engine. In order that the engine will operate in a manner to give a substantially constant heat exchanger temperature throughout the engine operating speed range it may be desirable to ensure that the fuel/air mixture is richer at full throttle than at part throttle.

It will be recognised that a carburetted version of the above engine can be produced if desired, the fuel/air mixture being introduced into the engine by way of the inlet valve 15 and being heated by passage through the heat exchanger 18 at the appropriate point in time. Spontaneous combustion of the fuel/air mixture will occur as it issues from the hot face of the heat exchanger. However, fuel injected versions of the kind shown in the drawings are preferred to carburetted versions at the present time, since the use of a fuel injection principle would appear to provide the engine designer with greater control of the combustion process within the engine, thus leading to greater efficiency, quieter operation, and cleaner exhaust emission. The preferred arrangement is to use a diesel-type high pressure fuel injection system timed to inject fuel into the swirl chamber near the top dead centre position of the piston 11. However, a low pressure fuel injection alternative could be utilized wherein the fuel is injected at the beginning of the compression stroke, that is to say at a point in time when the air pressure in the cylinder 12 and therefore in the swirl chamber 23, is low.

FIG. 7 is a graphic illustration of the motion of the displacer piston 27 during one complete operating cycle of the engine.

FIG. 8 illustates a two stroke engine operating on similar principles, but having a totally different mechanical structure.

The two stroke engine of FIG. 8 includes a cylinder block 31 having therein a cylindrical bore 32 closed at one end by a cylinder head 33. The cylinder head 33 is formed with a centrally disposed exhaust passage 34 communicating with the cylinder 32, and closable by way of an exhaust valve 35. Slidably disposed within the cylinder 32 is a metal sleeve 36 closed at its end adjacent the cylinder head 33 by a regenerative heat exchanger 37. Slidably disposed within the sleeve 36 is a piston 38 capable of driving a crank shaft of the engine by way of a connecting rod 39. A recess 41 in the wall of the cylinder 32 contains a fuel injector 42 and generally diametrically opposite the recess 41 the wall of the cylinder 32 is formed with an axially extending channel 43. The channel 43 extends from the cylinder head 33 at one end, to a point approximately half way along the axial length of the cylinder 32.

The sleeve 36 is reciprocable within the cylinder 32 by means of a drive crank 44 which is driven by the crank shaft of the engine, and which rotates at the same speed as the crank shaft of the engine. The crank 44 carries a part spherical bearing 45 which is received between a pair of part cylindrical walls 46, 47 projecting from the exterior of the sleeve 36 at right angles thereto. The walls 46, 47 and the bearing 45 which couple the crank 44 to the sleeve 36 are such that during rotation of the crank 44 the sleeve 36 is caused to reciprocate axially within the cylinder 32, and simultaneous with its axial reciprocatory movement there is an accompanying angular reciprocatory movement such that considering any point on the surface of the sleeve, then during one revolution of the crank 44 that chosen point on the surface of the sleeve 36 will describe an ellipse the plane of the ellipse being a cylindrical plane having its axis coincident with the axis of the sleeve.

Immediately below the position of the heat exchanger 37 the sleeve 36 is formed with a plurality of apertures 48, the apertures 48 being spaced around the circumference of the sleeve. Part way along the length of the sleeve 36 the sleeve is formed with a second set of apertures 49, the apertures 49 also being spaced around the circumference of the sleeve. Beneath the channel 43 the cylinder block 31 is formed with an air inlet passage 51.

The engine illustrated in FIG. 8 is intended to operate without any form of spark plug or similar ignition device once the engine has reached its operating temperature. Such an ignition device will be provided to assist the engine in starting from cold, and the operation of the engine will now be described assuming that the engine is already at operating temperature. Thus the heat exchanger 37 will have been heated by a previous operating cycle of the engine, and the inner face *37a* of the exchanger will be defined as the hot face of the exchanger while the face *37b* presented to the cylinder head 33 will be defined as the cold face of the exchanger.

As mentioned previously the crank 44 driving the sleeve 36 is itself driven from the crank shaft of the engine at the same speed of rotation as the crank shaft. The coupling between the crank 44 and the crank shaft is such that the movement of the sleeve 36, and thus the heat exchanger 37, is out of phase with respect to the movement of the piston 38, the phase of movement of the sleeve 36 trailing the phase of movement of the piston 38 by 40°. In addition, the throw of the crank 44 is such that the axial stroke of the sleeve 36 is half of that of the piston 38.

As the piston 38 is moving towards its bottom dead centre position, then at approximately 50° before bottom dead centre the exhaust valve 35 opens, and since the sleeve 36 trails the piston 38 by 40°, then it will be 90° above bottom dead centre, that is to say half way through a downward stroke. Although only one channel 43 is illustrated in the drawing, it will be understood that further channels 43 are disposed around the circumference of the cylinder 32. However, the angular orientation occupied by the sleeve 36 when it is 90° before bottom dead centre, and is descending towards bottom dead centre, is such that none of the apertures 48 is aligned with a channel 43. Since the engine is a two stroke engine, then at this point in the movement of the piston 38 combustion will have occurred, and hot exhaust products will be under pressure in the space between the piston 38 and the cylinder head 33. As the exhaust valve 35 opens there will be a flow of hot exhaust products through the heat exchanger 37 to the exhaust valve 35 so that the heat exchanger 37 is heated by the hot exhaust gases. At this stage also the apertures 49 in the sleeve 36 are closed by the piston 38. However, as the operating stroke continues the piston 38 will be moving downwardly relative to the sleeve 36 even though the sleeve 36 is moving downwardly relative to the block 31. At approximately 30° before bottom dead centre of the piston 38 the piston 38 exposes the apertures 49 and the apertures 49 communicate with the air inlet port 51, and equivalent ports 51 disposed around the circumference of the cylinder 32. The air inlet ports are supplied with cold air under pressure either from an external compressor, or from the crank case of the engine. It will be recognised that in a two stroke engine inlet air is compressed within the crank case by the downward movement of the piston, and in this engine the same principle can be employed. Thus the downward movement of the piston 38 compresses inlet air within the crank case, and when the apertures 49 align with the ports 51 the compressed air can flow into the space between the upper surface of the piston 38 and the heat exchanger 37. This inrush of inlet air displaces residual hot combustion products from the interior of the sleeve through the heat exchanger 37 and the exhaust valve 35 thus completing the heating of the heat exchanger 37. Close to the bottom dead centre position of the piston 38 the sleeve 36 will have rotated sufficiently far for the apertures 48 to communicate with the channels 43. The channels 43 define by-pass passages whereby the cold air can flow around, rather than through the heat exchanger 37. Thus with the piston 38 close to its bottom dead centre position the inlet air from the sleeve 36 starts to flow through the apertures 48 and the channels 43 and into the space between the cold face *37b* of the heat exchanger 37 and the cylinder head 33. The initial flow of air into this region displaces cold exhaust products through the exhaust 34, 35. The exhaust valve 35 now closes and the piston 38 passes its bottom dead centre position. The sleeve 36 is however still moving towards its bottom dead centre position, and thus the upper face of the piston 38 is approaching the hot face 37*a* of the heat exchanger. The inlet air is thus swept from the space between the heat exchanger and the piston 38 into the space between the heat exchanger 37 and the cylinder head 33 by way of the apertures 48 and the channels 43. During this movement the piston 38 covers, and therefore closes the apertures 49 preventing blow back of air through the inlet ports 51. At about 40° before top dead centre of the piston 38 the piston 38 has moved almost to contact the heat exchanger 37 and thus virtually the whole of the inlet charge of air has been swept from between the piston 38 and the heat exchanger 37 by way of the channels 43 to the space between the heat exchanger 37 and the cylinder head 33. Thus the inlet charge of air has been transferred to the cold face of the heat exchanger 37 without flowing through the heat exchanger. The continued movement of the sleeve 36 now reaches a point at which the rotation of the sleeve 36 breaks the communication between the apertures 48 and the channels 43. Both the piston 38 and the sleeve 36 are now moving upwardly, and thus the cold air charge is being compressed between the cylinder head 33 and the piston 38, and is thus being caused to flow through the heat exchanger 37 from the cold face 37*b* to the hot face 37*a* and in the process is being heated by the heat exchanger. The piston 38 reaches its top dead centre position, and then commences to move downwardly again, and by 40° after the top dead centre position of the piston 38 the sleeve 36 will have reached its uppermost position and almost all of the air will have passed through the heat exchanger and into the space between the piston 38 and the hot face of the heat exchanger 37. At some point between 10° before top dead centre and 20° after top dead centre of the piston 38 fuel will be injected by way of the injector 42, the fuel spraying into the sleeve 36 through one of the apertures 48. Spontaneous combustion occurs as a result of the high temperature of the air within the sleeve 36 and during the first half of the ensuing power stroke, since the heat exchanger 37 will be closely adjacent the cylinder head 33 then only a small fraction of the combustion products flow back through the heat exchanger to the cold side 37*b* thereof. The majority of the expansion of gases which occurs during combustion is thus used to drive the piston 38 in its power stroke. It will be recognised that at this stage the apertures 49 are still closed by the piston 38, and the apertures 48 are still out of alignment with the channels 43. However, by the time that approximately half of the power stroke is over, the sleeve 36 will have reached the point in its stroke where it is commencing to move downwardly more rapidly, closing the gap between the piston 38 and the heat exchanger 37, so that hot combustion products flow through the heat exchanger 37 from the hot face 37*a* to the cold face 37*b* thus heating the heat exchanger. By the time that the exhaust valve 35 opens again over half of the combustion products will have been displaced through the heat exchanger.

It will be recognised that thermodynamically the ideal situation would be to complete the power stroke and then to move the heat exchanger relative to the piston 38 so that all of the combustion products are passed through the heat exchanger and are cooled thereby, thus resulting in a constant volume cooling step which is completed before allowing the gases to pass through the exhaust valve. However, the arrangement which is described in which over half of the exhaust products are cooled by passing through the heat exchanger in the last half of the power stroke leads to an improvement in efficiency compared with completing the power stroke and then allowing the gases to flow through the heat exchanger to exhaust while expanding to atmospheric pressure and so cooling by adiabatic expansion.

Figure 9:
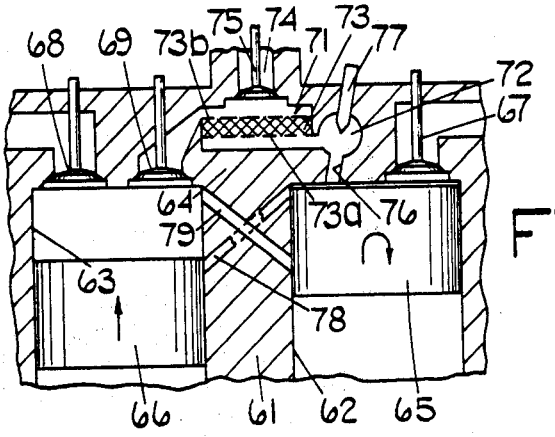
FIG. 9 is a view similar to FIG. 1 of an engine in accordance with a third example of the present invention.

A further alternative engine construction embodying the same operating principles as the previous two examples is shown in FIG. 9, and comprises an engine block 61 having therein a pair of parallel cylinders 62, 63 both closed at one end by a cylinder head 64. Slidably received within the cylinder 62 is a piston 65, a similar piston 66 being slidably received within the cylinder 63. The pistons 65 and 66 are each connected, by way of respective connecting rods, to a common crank shaft, and are arranged to be out of phase with one another, with the piston 66 trailing the piston 65 by between 50° and 90° of crank shaft rotation. The choice of angular displacement between the piston 65 and 66 is determined by the required compression ratio of the engine, the compression ratio with 50° displacement being 10:1, and being 5:1 with 90° displacement. In the example illustrated in FIG. 9 the piston 66 trails the piston 65 by 70° of crank shaft rotation. The position shown in FIG. 9 is with the piston 65 at top dead centre, and the piston 66 thus at 70° before top dead centre.

The cylinder head 64 contains an air inlet valve 67 whereby air can enter the cylinder 62, and a similar air inlet valve 68 whereby air can enter the cylinder 63. Associated with the cylinder 63 the cylinder head 64 also supports a transfer valve 69 and positioned within the cylinder head are a heat exchanger chamber 71 and a swirl chamber 72. A regenerative heat exchanger 73 is housed within the chamber 71 the hot face 73*a* of the heat exchanger 73 communicating with the swirl chamber 72 and the cold face 73*b* communicating with the transfer valve 69. Adjacent the cold face of the heat exchanger 73 the chamber 71 is provided with an exhaust passage 74 controlled by an exhaust valve 65. The swirl chamber 72 also communicates by way of a passage 76 with the cylinder 62, and a fuel injector 77 can inject fuel into the swirl chamber 72. A by-pass passage 78 connects the upper end of the cylinder 62 with a point intermediate the ends of the cylinder 63, and a similar by-pass passage 79 connect the upper end of the cylinder 63 with a point intermediate the ends of the cylinder 62.

Figure 10:
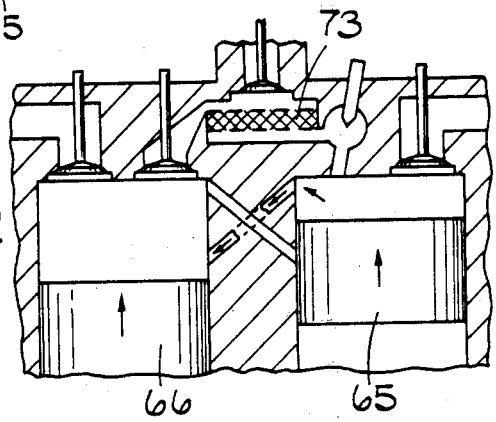
FIGS. 10 to 12 inclusive, are views illustrating the operating cycle of the engine shown in FIG. 9.
Figure 11:
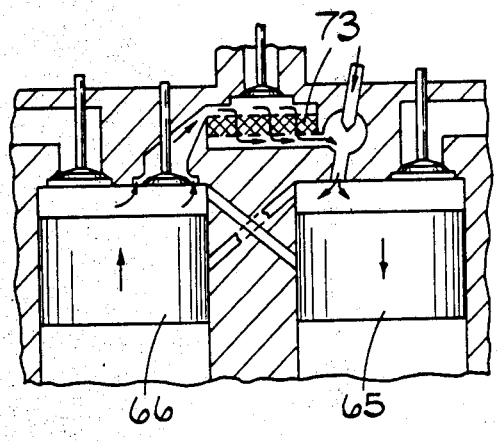

The engine operates as a four stroke engine in the following manner. The commencement of the induction stroke overlaps with the end of the exhaust stroke by virtue of the phase difference between the pistons 65 and 66. Thus as the piston 65 starts to descend from its top dead centre position in the induction stroke the valve 67 opens so that air is drawn into the cylinder 62. The passage 79 is closed by the piston 65, and the passage 78 is closed by the ascending piston 66. Exhaust gases at this stage in the cylinder 63 are being swept from the cylinder 63 by way of the open transfer valve 69 and the open exhaust valve 75. For the purposes of this explanation it is assumed that the heat exchanger 73 has already been heated by previous operating cycles. After 70° of crank shaft rotation from the top dead centre position of the piston 65 the piston 65 is still closing the passage 79, and the piston 66 is at top dead centre. The transfer valve 69 and the exhaust valve 75 close, and the inlet valve 68 opens so that during continued downward movement of the piston 65 and the initial part of the downward movement of the piston 66 air is being drawn into both cylinders 62 and 63. As the piston 65 reaches its bottom dead centre position the inlet valve 67 closes, and while the piston 66 is still descending the piston 65 starts to ascend towards its top dead centre position compressing the air in the cylinder 62 and displacing the air in the cylinder 62 by way of the passages 78 and 79 into the cylinder 63. As the piston 66 commences its upward movement the valve 68 closes so that at this stage all of the valves are closed. As the piston 65 passes the passage 79 it closes the passage 79 but air continues to be displaced from the cylinder 62 into the cylinder 63 by way of the passage 78 (FIG. 10). When the piston 65 reaches its top dead centre position the piston 66 will have ascended to the position shown in FIG. 9 wherein it closes passage 78 and thus substantially the whole of the inlet charge of air for both of the cylinders 62, 63 will now be in the cylinder 63 and will be in process of being compressed by the ascending piston 66. The transfer valve 69 now opens so that the ascending piston 66 drives air, which has been partially heated by compression, through the heat exchanger 73 from the cold face 73*b* to the hot face 73*a*, the air being heated by the heat exchanger during passage through the heat exchanger. The hot air thus passes into the swirl chamber 72 where it is mixed with fuel injected into the chamber 72 by way of the injector 77. The temperature of the air is such that spontaneous combustion occurs, and expanding gases drive the piston 65 downwardly as the piston 66 continues to move towards its top dead centre position thus continuing to sweep air through the heat exchanger to feed the combustion process in the swirl chamber 72 and cylinder 62 (FIG. 11).

Figure 12:
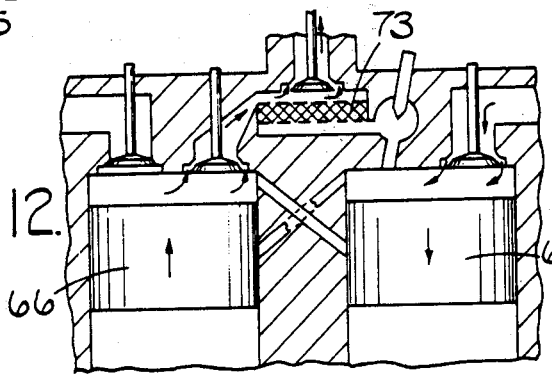

The transfer of air from the cylinder 63 to the cylinder 62 is completed as the piston 66 reaches its top dead centre position. At this point in the movement of the piston 66 the piston 65 is just about to uncover the passage 79 and the transfer valve 69 closes. As both pistons descend the expanding gases from the cylinder 62 can pass through the passage 79 into the cylinder 63 so that work is performed within the cylinder 63 and thus the piston 66 contributes to the power stroke of the engine. As the piston 65 passes bottom dead centre it commences its exhaust stroke, and the exhaust valve 75 opens. The ascending piston 65 thus drives hot exhaust gases through the passage 76 the swirl chamber 72 and through the heat exchanger 73 from the hot face thereof to the cold face, and then out through the exhaust passage 74. Part of the exhaust gases contained in the cylinder 63 will of course be swept from the cylinder 63 into the cylinder 62 by way of the passage 78 and then through the heat exchanger to further heat the heat exchanger. When the piston 65 reaches its top dead centre position and commences to descend the valve 67 opens so that fresh air can be drawn into the cylinder 62, and additionally the transfer valve 69 opens so that the remaining exhaust products in the cylinder 63 pass directly to the exhaust without flowing through the heat exchanger (FIG. 12). The cycle is then repeated. As with the previous examples an ignition device in the form of a spark, or a glow plug will be incorporated, preferably in the swirl chamber 72, in order to promote starting of the engine from cold.

As with conventional petrol and diesel engines the timing of the valve openings and closings will not normally coincide exactly with top dead centre and bottom dead centre of their respective pistons, and the optimum valve timings for each engine design will be determined by experiment.

A further example of a single cylinder four stroke engine is illustrated in FIG. 13 and comprises a cylinder block 81 having therein a cylinder 82 slidably receiving a piston 83. The cylinder head 84 is provided with an inlet valve 85 whereby air can enter the cylinder 82 and contains a chamber 86 communicating with the cylinder 82 by way of a port 87. An exhaust valve 88 communicates with the chamber 86 and is disposed in the same face of the chamber 82 as the port 87. A port 89 opposite the port 87 establishes communication between the chamber 86 and a swirl chamber 91 into which fuel can be admitted by way of an injector 92. A regenerative heat exchanger 93 is carried by a rotatable wheel 94 housed within the chamber 86. The wheel 94 is carried at one end of an axle 95 journalled for rotation in the cylinder head 84, the axis of rotation of the wheel 94 and axle 95 being parallel to the axis of reciprocatory movement of the piston 83. Diametrically opposite the heat exchanger 93 the solid part of the wheel 94 is formed with an aperture 96 the aperture 96 and the heat exchanger 93 are capable of establishing communication between opposite faces of the wheel 94, the periphery and part of the lower face of the wheel 94 being in sliding, but sealing contact with the cylinder head 84. The operation of the engine will now be described with reference to FIGS. 14 to 19 which illustrate various positions of the wheel 94 relative to the port 87 and exhaust valve 88.

As the piston 83 descends from its top dead centre position at the commencement of its induction stroke the valve 85 opens so that air is drawn from atmosphere into the cylinder 82. At this stage the wheel 94 is in the position shown in FIG. 18 and the heat exchanger 93 is already hot from a previous operating cycle. As the piston 83 passes its bottom dead centre position and commences to ascend it compresses air within the cylinder 82 and drives the air through the hot heat exchanger 93 into the chamber 91. The air is thus heated both by compression, and by passage through the hot heat exchanger. As the piston 83 reaches its top dead centre position it will be recognised that virtually all of the air which was drawn into the cylinder 82 has been compressed through the heat exchanger into the chamber 91. Immediately before the top dead centre position of the piston 83 during its compression stroke the wheel 94 is rotated to place the aperture 96 in communication with the port 87 and fuel is admitted to the chamber 91 through the injector 92. Spontaneous combustion occurs as a result of the temperature of the air in the chamber 91 and the rapidly expanding gases issue through the port 89, the aperture 96 and the port 87 and into the cylinder 82 to drive the piston 83 downwardly in its power stroke. The movement of the wheel at the top dead centre position of the piston is illustrated in FIG. 14. The piston 83 thus descends in its power stroke, and by the time the piston 83 reaches the bottom dead centre position of its power stroke the wheel 95 has rotated through the position shown in FIG. 15 to the position shown in FIG. 16 so that the heat exchanger overlies the exhaust valve 88. As the piston 83 passes the bottom dead centre position the exhaust valve 88 opens and since the valve 85 has been closed since the commencement of the compression stroke the hot exhaust gases contained within the cylinder 82 are swept, by the rising piston 83 through the port 87 and the aperture 96 and flow across the top of the wheel 94 then downwardly through the heat exchanger 93 and out of the engine by way of the open exhaust valve 88. In passing through the heat exchanger 93 from the hot upper face to the cold lower face the gases heat the heat exchanger in readiness for a further cycle of operation. The exhaust valve 88 is preferably opened prior to the piston reaching bottom dead centre in its power stroke so that exhaust gases commence to flow through the heat exchanger to exhaust prior to the commencement of the exhaust stroke. FIG. 16 shows the position immediately before bottom dead centre of the exhaust stroke, FIG. 17 shows the position of the wheel half way through the exhaust stroke, and FIG. 18 shows the position of the wheel at the end of the exhaust stroke and commencement of the induction stroke. Thus as the piston passes its top dead centre position at the end of the exhaust stroke the exhaust valve 88 closes, and the inlet valve 85 opens so that the subsequent downward stroke of the piston 83 draws a fresh charge of air into the cylinder 82 in readiness for a further operation. By the time that the piston 83 has reached the bottom of its induction stroke the hot heat exchanger will be back in position over the port 87 in readiness for the compression stroke to drive the fresh charge of air through the heat exchanger into the swirl chamber 91. It is to be understood that the wheel 94 is not intended to be moved between a series of static positions, but is continuously moving, and conveniently is driven from the crank shaft of the engine so as to rotate at half the rotational speed of the crank shaft.

As mentioned in connection with all of the previous examples an ignition device in the form of a spark plug, or glow plug will be incorporated into the swirl chamber 91 to facilitate ignition of the fuel/air mixture when the heat exchanger is cold. However, the ignition device will be rendered inoperative once normal engine operating temperature has been achieved.

It will be recognised that the aperture 96, and the path across the top of the wheel 94 together with the rotation of the wheel relative to the port 87, provide a by-pass arrangement whereby although the fresh air charge is driven through the heat exchanger from the cold face to the hot face, the exhaust gases by-pass the cold face of the heat exchanger, and during the same direction of movement of the piston as the compression stroke the exhaust gases are driven through the heat exchanger from the hot face to the cold face.

As with the first example described above each of the subsequent examples can operate as a carburetted engine rather than a fuel injected engine if desired. However, for the reasons given in relation to the first example the fuel injected version is preferred at the present time.

It will be recognised that in each of the above described engines the regenerative heat exchanger recovers heat from the exhaust gases and heats at least the air portion of the fuel/air mixture. Since the temperature to which the charge is raised is very high the fuel mixed with the heated air ignites spontaneously. Indeed the temperature of the air into which fuel is injected can be much higher than that normally attained purely by compression, for example as occurs in a conventional diesel engine. With the above described engines the engine designer can, when designing an engine, select the temperature of the heat exchanger (by controlling the amount of exhaust gases flowing through the heat exchanger in the previous cycle and by selecting the appropriate fuel/air ratio and compression ratio) and thus can control the temperature to which the air is raised. The designer can also control the rate and timing of transfer of the air through the heat exchanger, and the rate of timing of fuel injection. Thus the engine designer has considerable freedom of design, and the optimum rate and timing of combustion can be chosen for the intended operating conditions of the engine.

It can be seen that valve 27 in FIGS. 1–6, ports 49 and bypass channel 43 in FIG. 8, valve 69 in FIGS. 9–11 and valve 95 in FIGS. 13–19 all comprise a single valve means for preventing substantial flow through said heat exchanger prior to completion of the compression stage of the engine operating cycle. Depending upon the specific piston and cylinder arrangement, this valve means may be modified as necessary and any such modification will be obvious in view of the foregoing discussion of these specific embodiments.

The thermal efficiency of all of the engines described above can further be improved by insulating the crown of the piston, the wall of the cylinder and the cylinder head. Using such insulation, the heat which would normally be lost through these parts of the engine is retained in the system, effectively as an increase in the temperature of the products of combustion. Thus this heat retained by the use of insulation is recovered by the regenerative heat exchanger and is converted into useful work by being passed into the air passing through the heat exchanger in the next cycle.

By way of example it is intended that the above described engines will have a low compression ratio between 5:1 and 12:1 whereas conventional Diesel engines have high compression ratios of the order of 15:1 to 23:1 and the aforementioned Wishart engine has a very high compression ratio in the order of 30:1.

I claim:

1. A low compression ratio reciprocating piston internal combustion engine comprises at least one piston and cylinder arrangement including a working volume in which the compression and power stages of the engine operating cycle occer, the working volume being bounded in part by the piston crown and the cylinder head and in part by inlet valve means and exhaust valve means, said inlet valve means comprising means for permitting an inlet charge to enter the working volume, said exhaust valve means comprising means for permitting products of combustion occuring within the working volume to leave the working volume, said engine further comprising:

a regenerative heat exchanger located within said working volume, said heat exchanger having a hot face and a cold face between which gases are caused to flow, and, means for causing the charge to flow through the heat exchanger from the cold face to the hot face so as to be heated thereby immediately prior to the combustion stage of the engine operating cycle, wherein said means for causing comprises a single valve means for preventing substantial flow through said heat exchanger prior to completion of the compression stage of the engine operating cycle, the burning and expanding fuel/air mixture is caused to act directly on the piston of the piston and cylinder arrangement without passing through the heat exchanger, and the products of combustion are subsequently caused to flow through the heat exchanger from the hot face to the cold face to heat the heat exchanger before leaving the working volume by way of the exhaust valve means.

2. A low compression ratio reciprocating piston internal combustion engine comprises a piston and cylinder arrangement including a working volume in which the compression and power stages of the engine operating cycle occur, the working volume being bounded in part by the piston crown and the cylinder head and in part by inlet valve means whereby an inlet charge can enter the working volume and exhaust valve means whereby products of combustion occuring within the working volume can leave the working volume, a regenerative heat exchanger located within said working volume, the heat exchanger having a hot face and a cold face between which gases are caused to flow, and, means whereby the charge is caused to flow through the heat exchanger from the cold face to the hot face so as to be heated thereby immediately prior to the combustion stage of the engine operatine cycle, the burning and expanding fuel/air mixture is caused to act directly on the piston of the piston and cylinder arrangement without passing through the heat exchanger, and the products of combustion are subsequently caused to flow through the heat exchanger from the hot face to the cold face to heat the heat exchanger before leaving the working volume by way of the exhaust valve means, wherein the hot face of the regenerative heat exchanger is permanently exposed to the crown of the piston and said means whereby the charge can flow includes a by-pass whereby during compression of the inlet charge the charge can flow through said by-pass to the region of the cold face of the heat exchanger without passing through the heat exchanger.

3. A low compression ratio reciprocating piston internal combustion engine comprises a piston and cylinder arrangement including a working volume in which the compression and power stages of the engine operating cycle occur, the working volume being bounded in part by the piston crown and the cylinder head and in part by inlet valve means whereby an inlet charge can enter the working volume and exhaust valve means whereby products of combustion occuring within the working volume can leave the working volume, a regenerative heat exchanger located within said working volume, the heat exchanger having a hot face and a cold face between which gases are caused to flow, and, means whereby the charge is caused to flow through the heat exchanger from the cold face to the hot face so as to be heated thereby immediately prior to the combustion stage of the engine operating cycle, the burning and expanding fuel/air mixture is caused to act directly on the piston of the piston and cylinder arrangement without passing through the heat exchanger, and the products of combustion are subsequently caused to flow through the heat exchanger from the hot face to the cold face to heat the heat exchanger before leaving the working volume by way of the exhaust valve means, wherein said heat exchanger is movable within the working volume between a first position wherein the cold face thereof is exposed to the piston crown and a second position wherein the hot face is exposed to the piston crown, the exchanger occupying its first position during compression of the charge and dividing the working volume so that the charge is caused to be heated by passing through the heat exchanger from the cold face to the hot face prior to combustion and the heat exchanger occupying its second position during the power and exhaust stages wherein the burning and expanding fuel/air mixture can act directly on the piston, and the resultant products of combustion are caused to flow through the heat exchanger from the hot face to the cold face, heating the heat exchanger, to leave the working volume by way of the exhaust valve means.

4. An engine as claimed in claim 2 wherein said heat exchanger is static within said working volume, and said means whereby the charge can flow further includes a displacer piston movable within said working volume to drive the compressed charge through the heat exchanger from the cold face to the hot face, said by-pass permitting the compressed charge to flow into a region of the working volume between the displacer piston and the cold face of the heat exchanger.

5. An engine as claimed in claim 2 wherein said heat exchanger is movable relative to the cylinder of the piston and cylinder arrangement and relative movement between the piston and the heat exchanger drives the charge through the by-pass from the hot face of the heat exchanger to the cold face without passing through the heat exchanger.

6. An engine as claimed in claim 1 wherein the piston and cylinder arrangement includes a first piston and cylinder and a second piston and cylinder and passage means provides communication between the first and second cylinders, the swept volume of the first and second cylinders and the volume of said passage means contributing to the total working volume of the arrangement said pistons being coupled to a common crankshaft but being out of phase by a predetermined arc of crankshaft rotation with the first pistion leading the second piston, and during compression of an inlet charge initially said charge is exposed to the hot face of the heat exchanger but is compressed by both pistons into the second cylinder which during the conclusion of the compression stroke is exposed to the cold face of the heat exchanger so that the compressed charge can flow through the heat exchanger from the cold face to the hot face immediately before combustion takes place.

7. An engine as claimed in claim 6 wherein said heat exchanger is located in a passge of said passage means with its hot face permanently exposed to the first piston and its cold face exposed, when a transfer valve is open, to the second piston, said exhaust valve means being exposed to the heat exchanger cold face and said inlet valve means comprising first and second inlet valves providing inlets to the first and second cylinders respectively and said passage means including conduit means which, together with that part of said passage from the second cylinder to the heat exchanger cold face, defines a by-pass whereby during the conclusion of the compression stage of the engine operating cycle compressed charge from the first cylinder can reach the cold face of the heat exchanger without flowing through the heat exchanger from the hot face thereof.

8. An engine as claimed in anyone of the preceding claims wherein irrespective of how the charge is caused to flow through the exchanger from cold fact to hot face, the products of combustion are caused to flow through the exchanger from hot face to cold face by the movement of the piston of the arrangement towards top dead centre.

9. An engine as claimed in anyone of claims 1 to 7 wherein the inlet charge is air and fuel is supplied into the working volume via a fuel injector.

10. An engine as claimed in claim 9 wherein fuel injection occurs to proximate the hot face of the heat exchanger.

11. An engine as claimed in claim 10 wherein the working volume includes a swirl chamber which receives heated charge from the exchanger and the fuel injector is arranged to supply fuel to the swirl chamber.

12. An engine as claimed in claim 8 wherein the inlet charge is air and fuel is supplied into the working volume via a fuel injector.

13. An engine as claimed in claim 12 wherein fuel injection occurs to proximate the hot face of the heat exchanger.

14. An engine as claimed in claim 13 wherein the working volume includes a swirl chamber which receives heated charge from the exchanger and the fuel injector is arranged to supply fuel to the swirl chamber.

* * * * *